United States Patent [19]

Armbruster

[11] 4,135,230

[45] Jan. 16, 1979

[54] FLASHLIGHT

[76] Inventor: Joseph M. Armbruster, 2521 NE. 4th Ave., Pompano Beach, Fla. 33064

[21] Appl. No.: 768,704

[22] Filed: Feb. 15, 1977

[51] Int. Cl.[2] ..... F21L 1/00

[52] U.S. Cl. ..... 362/206; 362/202

[58] Field of Search ..... 362/203, 205, 206, 204, 362/202, 194

[56] References Cited

U.S. PATENT DOCUMENTS

| | | | |
|---|---|---|---|
| 1,223,883 | 4/1917 | James et al. | 240/10.6 R |
| 2,443,539 | 6/1948 | Kopp | 362/206 |

*Primary Examiner*—Samuel W. Engle
*Assistant Examiner*—Ralph Palo
*Attorney, Agent, or Firm*—Clarence A. O'Brien; Harvey B. Jacobson

[57] ABSTRACT

An elongated tubular body constructed of conductive material is provided and includes open front and rear ends. A combined reflector and lens assembly is supported from the front end of the body and a bulb is removably supported from the reflector and lens assembly and includes center and base terminals with the base terminal electrically connected, by the reflector and the lens assembly, to the body and the center terminal supported out of electrical connection with the body. Battery structure is slidably disposed within the body and includes a forwardly facing forward terminal in electrical contact with the center terminal of the bulb and a rearwardly facing rear terminal. A thick walled sleeve is disposed and longitudinally slidable in the rear end of the body and is constructed of deformable, resilient dielectric material. The front end of the sleeve includes a contact electrically contacting the rear terminal of the battery structure and a thrust member is mounted in the rear end of the body behind the sleeve for adjustable positioning therealong to variably bias the sleeve and thus the battery, forwardly in the body. The thrust member is constructed of conductive material and is in electrical contact with the body. A switch structure is supported from the thrust member and includes a switch actuator therefore disposed in recessed position within the rear end of the body and operable from the exterior thereof. The switch defines a ground terminal which is grounded to the thrust member and a second terminal which is insulated relative to the thrust member and disposed within the interior of the sleeve. A conductor wire is connected between the second terminal of the switch and the contact carried by the front end of the sleeve.

3 Claims, 3 Drawing Figures

FLASHLIGHT

BACKGROUND OF THE INVENTION

Various forms of battery operable flashlights have been heretofore provided. However, many forms of prior known flashlights are constructed in a manner so as to be susceptible to malfunction due to corrosion and many other forms of prior known flashlights are not readily adaptable for construction in a substantially watertight form. Still further, some forms of flashlights include structural feature which require that a considerable number of components thereof be altered in order to vary the construction of the flashlight so as to receive, two, three, four, or more, flashlight batteries.

Examples of various forms of previously known flashlights including some of the general structural and operational features of the instant invention are disclosed in U.S. Pat. Nos. 2,346,695, 2,377,194, 2,810,822, 3,316,396, and 3,662,166.

BRIEF DESCRIPTION OF THE INVENTION

The flashlight construction of the instant invention is constructed in a manner whereby only one component thereof must be changed in order to transform the flashlight so as to be wholly operable with a different number of flashlight batteries. Further, the flashlight is constructed in a manner whereby malfunction due to corrosion of component parts is maintained at a minimum and the flashlight is still further constructed in a manner which lends itself readily to waterproof construction.

The main object of this invention is to provide a flashlight construction including structural features thereof which tend to reduce the possibility of malfunction of the flashlight due to corrosion of any components thereof.

Another object of this invention is to provide a flashlight construction which may be readily varied so as to accept a different number of flashlight batteries.

Another very important object of this invention is to provide a flashlight construction including a fully recessed control switch thereof which is substantially fully protected against damage by impact with a foreign object.

Another object of this invention is to provide a flashlight which may be considered as substantially waterproof.

A final object of this invention to be specifically enumerated herein is to provide a flashlight construction in accordance with the preceding objects and which conform the conventional forms of manufacture, be of simple construction and easy to use, so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 3:
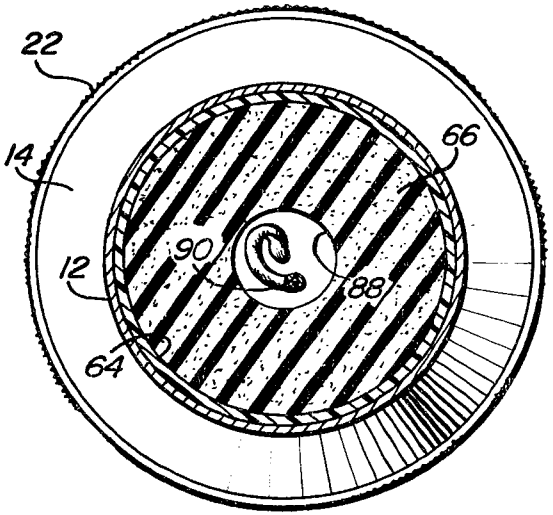
FIG. 3 is an enlarged, transverse, sectional view taken substantially upon the plane indicated by the section line 3—3 of FIG. 2.
Figure 1:
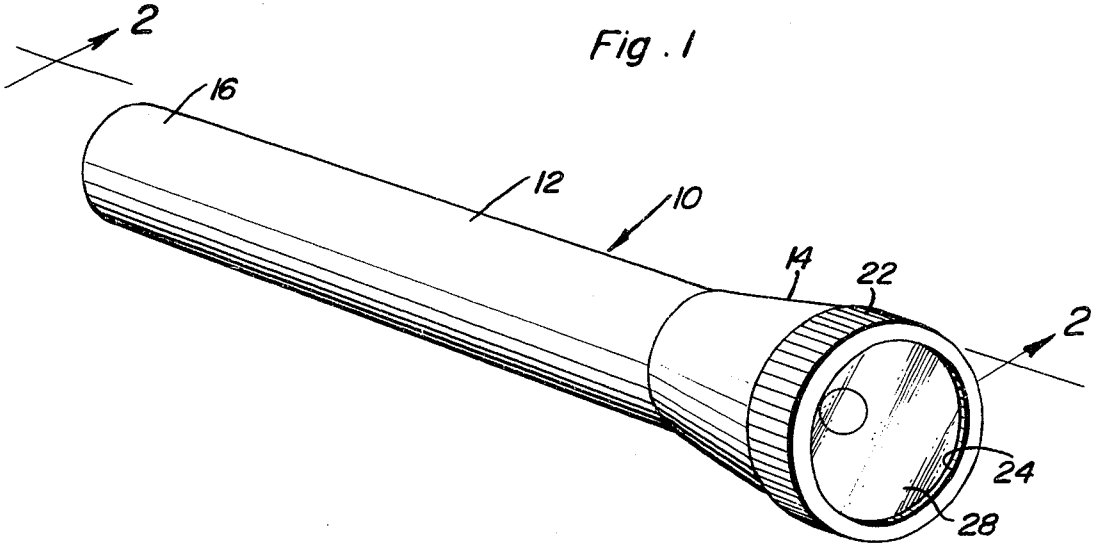
FIG. 1 is a perspective view of a flashlight constructed in accordance with the present invention.

Referring now more specifically to the drawings, the numeral 10 generally designates the flashlight of the instant invention. The flashlight 10 includes an elongated tubular body 12 constructed of conductive material, such as aluminum, and the body 12 includes front and rear end portions 14 and 16. The front end portion 14 is slightly flared and its terminal end is externally threaded as at 15 and has a combined reflector and lens assembly referred to in general by the reference numeral 18 removably threadedly engaged therewith, the assembly 18 including a removable bulb 20.

The lens and reflector assembly 18 includes a cap 22 having a central opening 24 formed in its end wall 30 and the cap 22 is internally threaded as at 26 and is removably threaded on the terminal end of the forward end portion 14 with the outer periphery of a transparent lens panel 28 held captive immediately inwardly of the periphery of the end wall 30 of the cap 22 having the opening 24 formed therein. The end wall 30 includes a groove 32 formed therein opening toward the remote end of the cap 22 and a sealing ring 34 is seated in the groove 32 and forms a fluid tight seal between the end wall 30 and the lens panel 28.

The assembly 18 further includes a reflector body 36 having the usual outer peripheral flange 38 and the flange 38 is clamped between the rear side of the lens plate 28 and the axial end of the terminal end portion 16. The rear center portion of the reflector 36 includes an opening 40 therein about which a rearwardly projecting sleeve 42 is secured. The sleeve 42 is internally threaded and a nylon sleeve 44 having a large diameter rear end portion 46 and a smaller diameter forward end portion 48 is provided with circumferentially spaced and radially outwardly projecting and longitudinally extending ribs 50 on its forward end portion 48 which are threadedly engaged in the sleeve 42. The bulb 20 includes a base terminal 52 provided with a forward end radially outwardly projecting flange 54 and the front end portion 48 of the sleeve 44 clamps the flange 54 of the bulb 20 between the forward end portion 48 and that portion of the reflector 36 defining the opening 40 through which the bulb 20 projects, the terminal 52 extending through the forward end portion 48 of the sleeve 44. The rear end of the bulb 20 includes a rearwardly facing center terminal 54 which projects into the large diameter rear end portion 46 of the sleeve 44 and a conductive expansion spring 56 is disposed within the large diameter rear end portion 46 and has its forward end in electrical contact with the terminal 54.

A pair of conventional flashlight batteries 58 including center forward terminals 60 and rear terminals 62 are slidably disposed within a dielectric protective sleeve 64 snugly received within the body 12. The batteries 58 are disposed in tandem relation with the forward terminal of the front battery 60 engaged with the rear end of the conductive spring 56 and the forward terminal 60 of the rear battery 58 engaged with the rear terminal 62 of the front battery 60.

A thick walled axially compressible sleeve 66 is disposed and longitudinally slidably received within the sleeve 64 and is constructed of deformable and resilient dielectric material. The front end of the sleeve includes a contact disk 68 including forwardly dimpled portions 70 in electrical contact with the rear terminal 62 of the rear battery 58 and a thrust disk 72 is removably threadedly engaged in the rear end portion 16 of the body 12 and includes rearwardly opening recesses 76 which may be engaged by a spanner wrench in order to remove the thrust disk 72. The disk 72 is threaded into the rear end portion 16 of the body 12 to a position wherein the resilient sleeve 66 is slightly axially compressed in order to insure good electrical contact between the dimpled portions 70 of the disk 68 and the rear terminal 62 of the rear battery 58. In addition, the front terminal 60 of the rear battery 58 is assured good electrical contact with the rear terminal 62 of the front battery 58 and the front terminal 60 of the front terminal 58 is assured good electrical contact with the spring 56. In addition, it is pointed out that the flange or shoulder 54 is electrically connected to the terminal 52 and the reflector 36 is constructed of conductive material whereby the flange or shoulder 54 is electrically connected to the forward terminal end of the body 12 through the reflector 36.

The center of the disk 72 has a bore 80 formed therethrough and a manually operable switch assembly 82 has its ground terminal defining body portion 84 secured through the bore 80 in electrical contact with the disk 72 by means of a threaded nut 84. The switch 82 includes a second terminal 86 centrally supported within the bore 88 formed through the sleeve 66 and the terminal 86 is electrically connected to the disk 68 by means of a connector wire 90. The ground terminal 84 of the switch 82 is electrically connected to the disk 72 and the latter is in turn electrically connected to the body 12 by means of the threaded connection between the disk 72 and the rear end portion 16 of the body 12. The switch 82 includes a push-pull operator 92 recessed within the rear end portion 16 of the body 12 and which may be readily digitally actuated from the exterior of the rear end portion of the body 12. Of course, the switch 82 is operative to electrically connect the terminals 84 and 86 when the switch is in the "on" position whereby the batteries 58 and bulb 20 will be connected in series within an electrical circuit, thus causing the bulb 20 to be actuated. In addition, the switch 82 is operative to open the circuit between the terminals 84 and 86 so as to thereby terminate electrical actuation of the bulb 20.

Figure 2:
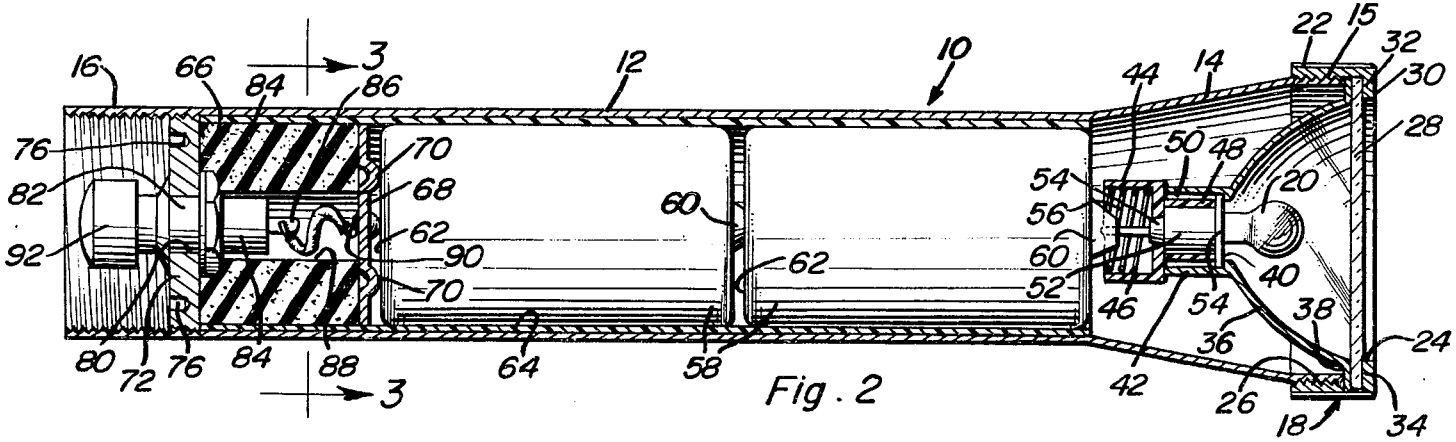
FIG. 2 is an enlarged longitudinal, vertical, sectional view taken substantially upon the plane indicated by the section line 2—2 of FIG. 1.

From FIG. 2 of the drawings, it may be seen that the disk 72 is threaded into the rear end portion 16 of the body 12 sufficiently to cause a reasonably good fluid tight seal between the body 12 and the disk 72. Further, the switch 82 is to be considered as a switch of waterproof construction. Therefore, it may be seen that the flashlight 10 is substantially waterproof.

It is also pointed out that damage to the switch 82 by impact with a foreign object is substantially eliminated inasmuch as the switch 82 is supported from the rigid thrust member 72 is recessed position within the rear end portion 16 of the body 12.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A battery actuated flashlight including an elongated tubular body having open front and rear ends, said body being constructed of conductive metal, a combined reflector and lens assembly supported from the front end of said body, a bulb including center and base terminals removably supported from said reflector and lens assembly with said base terminal electrically connected, by said assembly, to said body and said center terminal out of electrical connection with said body, battery means slidably disposed in said body including a forward facing forward terminal in electrical contact with said center terminal and a rearwardly facing rear terminal, a thick walled sleeve disposed and longitudinally slidable in said rear end of said body and constructed of deformable and resilient dielectric material, a conductive contact disk slidable in said body and disposed across the front end of said sleeve defining a contact electrically contacting said rear terminal, a thrust member threadedly mounted in the rear end of said body and adjustable positioning therealong for variably axially compressing and biasing said sleeve, and thus said battery, forwardly in said body, said thrust member being constructed of conductive material and being in electrical contact with said body, and switch means supported from said thrust member and including a switch actuator therefor disposed in recessed position within said rear end of said body and operable from the exterior thereof, said switch means defining a ground terminal therefor grounded to said thrust member and a second terminal insulated relative to said thrust member and disposed within the interior of said sleeve, and means within the interior of said sleeve electrically connecting said second terminal to said contact, said switch means being secured through a central portion of said thrust member and said actuator comprising a portion of said switch means projecting rearwardly of said thrust member into the rear end of said sleeve.

2. The combination of claim 1, including a dielectric protective sleeve snugly telescoped within said body forward of said thrust member and extending forwardly to a point adjacent said assembly, said battery means being slidingly received in said dielectric protective sleeve.

3. A battery actuated flashlight including a hollow body defining first and second openings opening thereinto, a bulb supporting combined reflector and lens assembly removably closing said first opening, battery means in said body and removably therefrom through said second opening, a closure for said second opening for retaining said battery means in said body, said closure being removably supported from said body in recessed position relative to the outermost extremity of said second opening, said battery means and body including means defining an electrical circuit for electrically connecting said battery means to said bulb for electrical actuation of the latter, said circuit defining means including a manually operable switch serially connected in said circuit and supported from said closure in fully inwardly recessed position relative to the outermost extremity of said second opening and including an operator manually operable by digital manipulation from exteriorally of said second opening, said body comprising an elongated tubular body having front and rear ends, said first and second openings opening outwardly of said front and rear ends, respectively, said closure comprising a closure body removably threadedly supported within the rear end of said tubular body centrally through which said switch is secured, said operator being disposed rearwardly of said closure body and fully recessed within the rear end of said elongated tubular body.

* * * * *